US005509178A

United States Patent [19]

Egerer

[11] Patent Number: 5,509,178

[45] Date of Patent: Apr. 23, 1996

[54] FEED COMB ARRANGEMENT

[75] Inventor: Josef Egerer, Schwabach, Germany

[73] Assignee: Staedtler & Uhl, Schwabach, Germany

[21] Appl. No.: 352,700

[22] Filed: Dec. 2, 1994

[30] Foreign Application Priority Data

Dec. 14, 1993 [DE] Germany ..... 43 42 561.5

[51] Int. Cl.[6] ..... D01G 19/02; D01G 19/10

[52] U.S. Cl. ..... 19/215; 19/115 R

[58] Field of Search ..... 19/115 R, 105, 19/215, 216, 218, 220, 223, 225, 129 R

[56] References Cited

U.S. PATENT DOCUMENTS

| | | | |
|---|---|---|---|
| 23,732 | 4/1859 | Whipple | 19/215 X |
| 717,380 | 12/1902 | Fraser | 19/115 R |
| 1,979,509 | 11/1934 | Van Hill | 19/115 R |
| 2,130,599 | 9/1938 | Redman | 19/115 R |
| 2,383,804 | 6/1958 | Boer | 19/115 R X |
| 3,474,502 | 10/1969 | Pohland | 19/115 R X |
| 3,854,169 | 12/1974 | Mackie . | |
| 3,889,318 | 6/1975 | Leinek et al. | 19/105 |
| 4,564,979 | 1/1986 | Ramasco | 19/115 R X |

FOREIGN PATENT DOCUMENTS

| | | |
|---|---|---|
| 0184671 | 3/1989 | European Pat. Off. . |
| 120741 | 4/1901 | Germany . |
| 2548315 | 5/1977 | Germany . |
| 9302628.5 | 4/1993 | Germany . |
| 654599 | 2/1986 | Switzerland . |

*Primary Examiner*—John J. Calvert
*Attorney, Agent, or Firm*—Browdy and Neimark

[57] ABSTRACT

In a feed comb arrangement for a combing machine comprising an intermittently driven pair of feed rollers preceding the feed comb arrangement in the transport direction of the fiber web to be combed and a take-down arrangement, in particular in the form of take-down rollers, following the feed comb arrangement, it is provided for the purpose of increasing smoothness of running, of avoiding accumulations of impurities and of attaining an effective transport that the feed comb arrangement is formed by a plurality of fallers, which are intermittently driven in synchronization with the combing operation and which are covered with needles or saw-toothed stamped elements, respectively, which fallers extend on their two outer ends into closed guideways in such a manner, that during part of the route of rotation the needles or saw-toothed points, respectively, engage with the fiber web and on the other hand the needles or saw-toothed points, respectively, upwardly leave the fiber web after having traveled a transport motion.

6 Claims, 3 Drawing Sheets

FEED COMB ARRANGEMENT

BACKGROUND OF THE INVENTION

1. Field of the Invention

The invention relates to a feed comb arrangement for a combing machine comprising an intermittently driven pair of feed rollers preceding the feed comb arrangement in the transport direction of the fiber web to be combed and a take-down arrangement, in particular in the form of take-down rollers, following the feed comb arrangement.

2. Background Art

Conventionally, the feed comb arrangement is formed by a flat feed comb covered with a plurality of needles, which feed comb has the object of transporting the fiber web to be combed in the transport direction to the comb roller and to the nippers arrangement in accordance with and in synchronization with the cycle of the combing operation.

A further object of the feed comb is to compress and retain the fibers out of the transport phase, when the take-down rollers draw the combed fibers off the fiber web. Accordingly, clinging fibers are separated from the fibers to be drawn off by means of the feed comb.

Within a combing operation the course of motion is such that the feed rollers transport the fiber web over a certain distance in the direction of the combing cylinder and of the take-down rollers. This refeeding is effected as a rule in that moment, in which the fibers already combed are drawn off the fiber web retained by the feed comb. The feed comb is closed in this moment and the needles of the feed comb penetrate the fiber web. After completion of the feeding, i.e. of the transport motion by the feed rollers, the feed comb is lifted off the fiber web and moves back by that distance, which corresponds to the transport distance by feed rollers.

The feed comb then pierces again the fiber web through the feed comb grid and carries out a new transport motion for the fiber web. The feed comb remains closed as long as the take-down rollers have drawn off the combed fiber web. A new combing operation is then started and the feed comb opens again and releases the fiber web for feeding the feed comb rollers.

Conventional feed combs are realized such that the needles in the form of needle bars are inserted into a base plate, each needle bar comprising a plurality of needles arranged side by side.

The conventional feed combs embodied in such a manner show a considerable disadvantage in that with respect to the fiber web they act also as a combing element and cleaning element apart from their transport and retain function, so that again and again larger parts of burrs and straw accumulate on the needles of the feed comb. These accumulations grow and are then drawn off in compressed form, while they are often transported through and below the following top comb because of their size and accordingly are left as an impurity in the combed fiber web.

To avoid this, one can only proceed by stopping the combing machine after certain running times, in order to clean the feed comb, which of course results in undesired losses of production.

A further considerable mechanical disadvantage of known feed combs is that within a combing operation they must run through four motion phases in different directions. These motion phases comprise an approximately circular arc-like motion, for leaving the fiber web, a linear motion directed backwards, for being able to initiate a new feeding phase, a further circular motion for piercing the fiber web and then again a linear motion for carrying out transport. Jerky motions of this type with about 200 combing operations per minute result in that a combing machine of the type considered works rather unsteadily.

SUMMARY OF THE INVENTION

With the above considerations in mind it is the object of the invention to create a feed comb arrangement, which avoids the disadvantages of conventional feed combs, in particular the accumulation of impurities, and which enables a reliable transport and retaining capacity with a high smoothness of running.

This object is attained in accordance with the invention by the feed comb arrangement comprising a plurality of fallers continuously rotating on a closed path, the path of rotation being formed such that the needles of the needle bars engage with the fiber web during part of the route of rotation and in a first phase retain and in a second phase transport the fiber web in synchronization with the course of the combing operation due to an intermittent drive.

The feed comb arrangement according to the invention, which is formed in the style of a feed comb head, comprises a housing, which has curved paths formed on the inner side of the lateral housing cheeks. Two inner curved paths serve for transporting the fallers, whereas two outer paths may be used to provide the fallers, which preferably are provided with unilateral cranks, with the desired angular position of the needles.

As an alternative, it is also possible to go without the inner paths of the fallers and to provide bearing of the fallers in special bearing parts on one continuously rotating chain each instead, so that the chains assume transport and bearing of the fallers. A transport mechanism of this type is described for example in U.S. Pat. No. 3,854,169.

A person skilled in the art knows an arrangement of this type as a continuously driven means from so-called drawing equipments (comp. German Published Application 25 48 315), wherein the drive of the fallers with prior art drawing equipments may be performed either via a chain or via a linear drive (comp. European Patent 0 184 671). The substantial difference of a feed comb arrangement according to the invention to prior art drawing equipments apart from the different purpose and field of application mainly lies in the fact that the feed comb arrangement according to the invention is driven intermittently.

A further difference is that the drawing equipment serves to prevent that the fiber web tears off, which is drawn between two pairs of rollers, which for this purpose run continuously with a varying rotating speed, e.g. with a speed ratio of 1:8. Accordingly, known drawing equipment just need not assume any transport function and alternately hereto any retaining function.

The fallers, which are used in the feed comb arrangement according to the invention, are embodied such that on one side of the faller the mentioned crank is provided, by which the angular position of the needle bar is given. On the two end sides of each faller bearings are provided, which engage with the guide curves for the motion of rotation. The bearings of the faller adjust also the alternating distance of the fallers to each other. The needles or the needle-like stamped elements of the faller, respectively, are fixed against rotation on the faller and extend over the central region according to the width of the fiber web.

The fallers are driven for example via chain wheels, which provide that in the interval of the combing operation the fallers carry out a certain distance in the direction of the take-down rollers, which distance is given as a transport distance by the feed rollers. The drive mechanism is preferably realized in such a manner that a drive wheel is driven synchronously to the feed comb rollers, and that preferably in direct relationship to the intermittent motion.

Consequently, this means that if the feed rollers transport the fiber web by a certain amount, the fallers of the feed comb arrangement run linearly by a corresponding distance in the transport direction. As a feed comb arrangement according to the invention or such a feed comb head, respectively, is connected stationarily with the machine, the needle rows of the fallers effect a retaining force onto the fiber web, as is the case with conventional feed combs, if the combed fibers are drawn off the fiber web by means of the take-down rollers.

As the fallers perform a rolling motion and an overlapped linear transport motion in accordance with the combing operation of the machine, all needle bars, which were engaged with the fiber web, upwardly leave the fiber web afterwards, are lifted and can be cleaned by a cleaning means, which may be realized by a brush or by a suction means, before they pierce again the fiber web after deflection.

By means of this a substantial advantage is attained by the invention, because the fallers are cleaned again and again and are cleared of impurities, which they have taken up during transport of the fiber web and during drawing off. In addition, a motion of rotation of this type is considerably more advantageous with respect to mechanical requirements, as a motion of rotation with rounded path portions ensures a largely better smoothness of running than successive motion, which are each displaced by approximately 90°.

The invention will become apparent from the ensuing description of a preferred example of embodiment taken in conjunction with the drawing.

DESCRIPTION OF THE PREFERRED EMBODIMENT

Figure 1A:
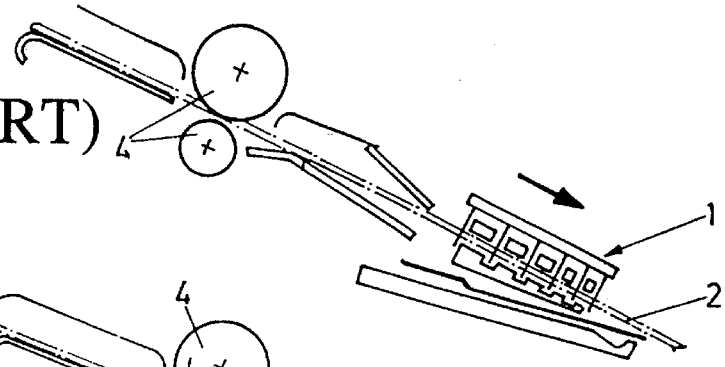
FIG. 1a (PRIOR ART)
FIG. 1*a* to 1*d* show the region of a feed comb according to prior art in a combing machine in different motion phases of the feed comb.
Figure 1B:
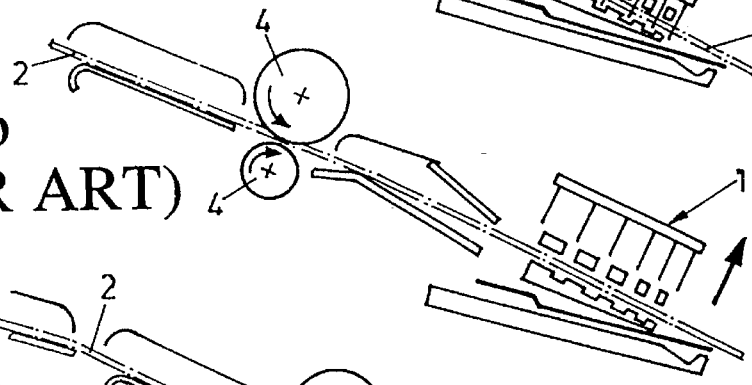
FIG. 1b (PRIOR ART)

In FIG. 1 a feed comb 1 according to prior art is shown. In a combing machine not shown in detail a fiber web 2 to be combed is fed to a nippers arrangement 5 in the transport direction (arrow 3) by a pair of feed rollers 4, wherein with a closed nippers arrangement 5 a projecting part of the fiber web 2 is combed through a circular comb 6 and the combed part is again drawn off via a pair of take-down rollers 7. The construction of a combing machine of this type, which may employ also a feed comb arrangement according to the invention, becomes apparent for example from the company publication "NSC Flachkämm-Maschine PV30" of n.schlumberger & cie.

The feed comb 1 shown in FIG. 1 performs a cycle of motion, which according to FIG. 1*a* comprises a linear transport motion for effecting the feeding. Subsequently, the feed comb 1 is lifted upwards in an approximately circular arc-like motion, to leave the fiber web, as it is shown in FIG. 1*b*.

Figure 1C:
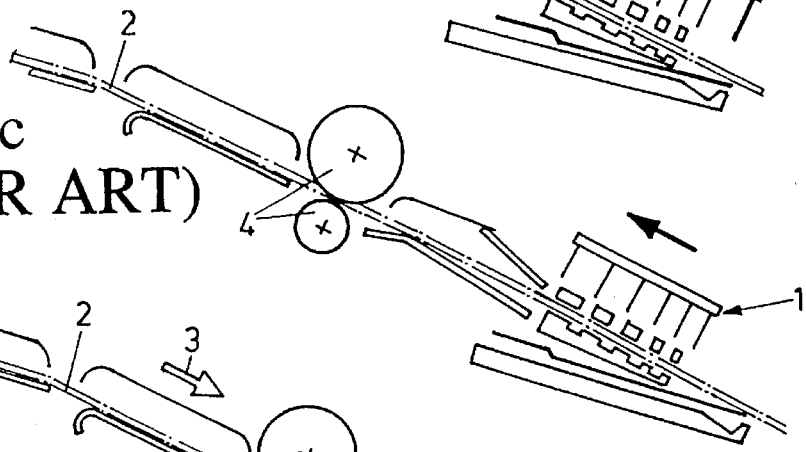
FIG. 1c (PRIOR ART)
Figure 1D:
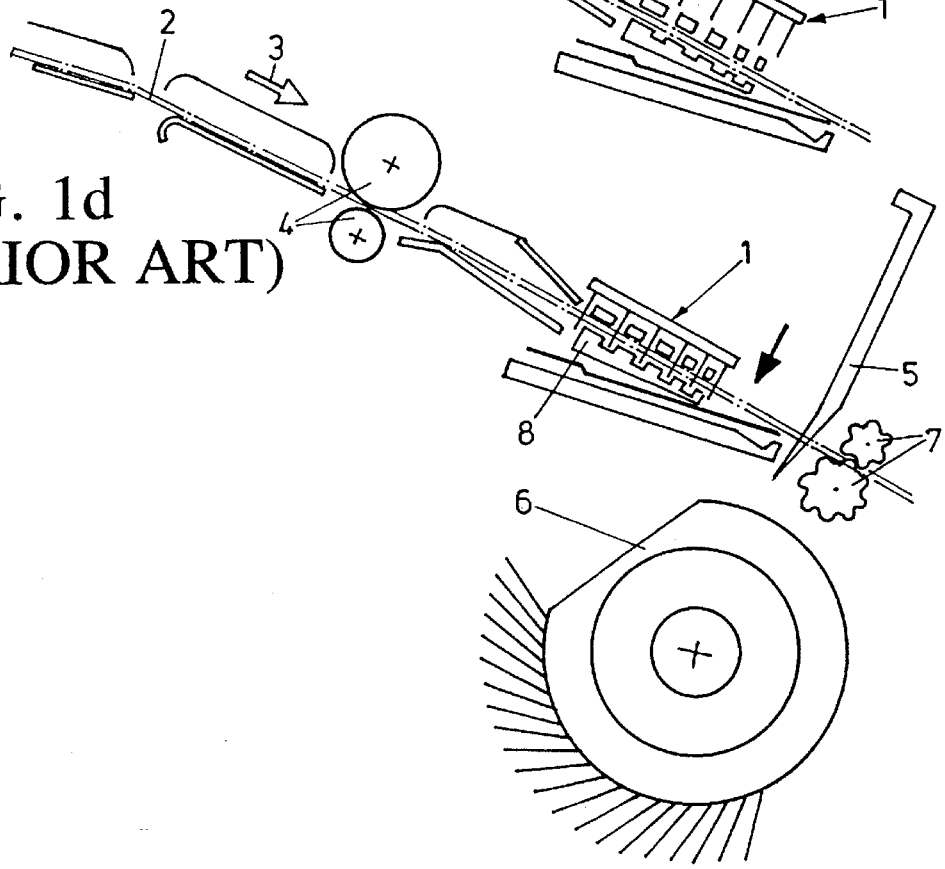
FIG. 1d (PRIOR ART)

This is followed by a linear motion directed backwards, which is shown in FIG. 1*c*, for being able to initiate new feeding of the fiber web 2, which motion in turn is followed by a circular motion for piercing the fiber web 2, as it is shown in FIG. 1*d*, the feed comb 1 then engaging with the feed comb grid 8.

Figure 2:
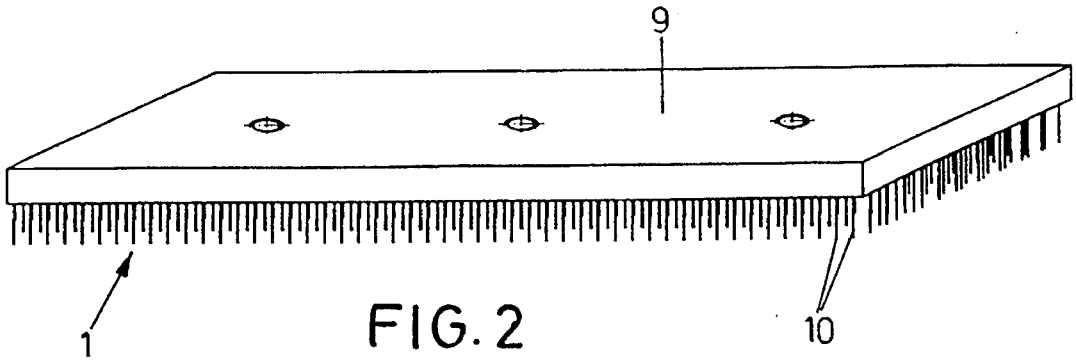
FIG. 2 (PRIOR ART)
FIG. 2 shows a perspective view of a feed comb according to prior art.

As can be seen from the prespective view in FIG. 2, a conventional feed comb 1 comprises a plane, plate-like base body 9 and a plurality of needle rows 10.

Figure 4:
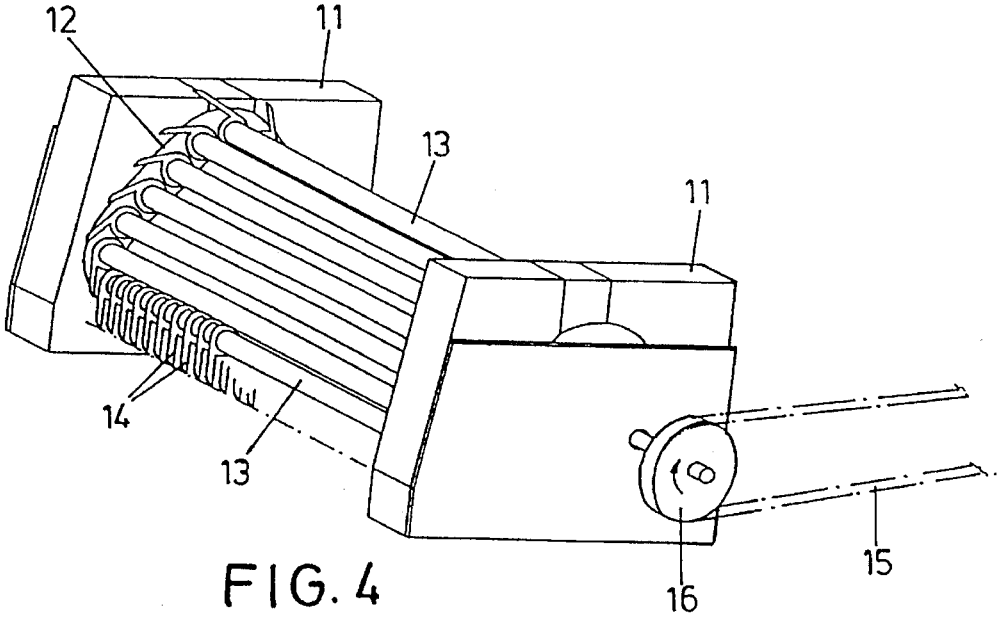
FIG. 3 shows a view corresponding to FIG. 1 of a feed comb arrangement according to the invention and FIG. 4 shows a perspective view of a feed comb arrangement according to the invention.
Figure 3:
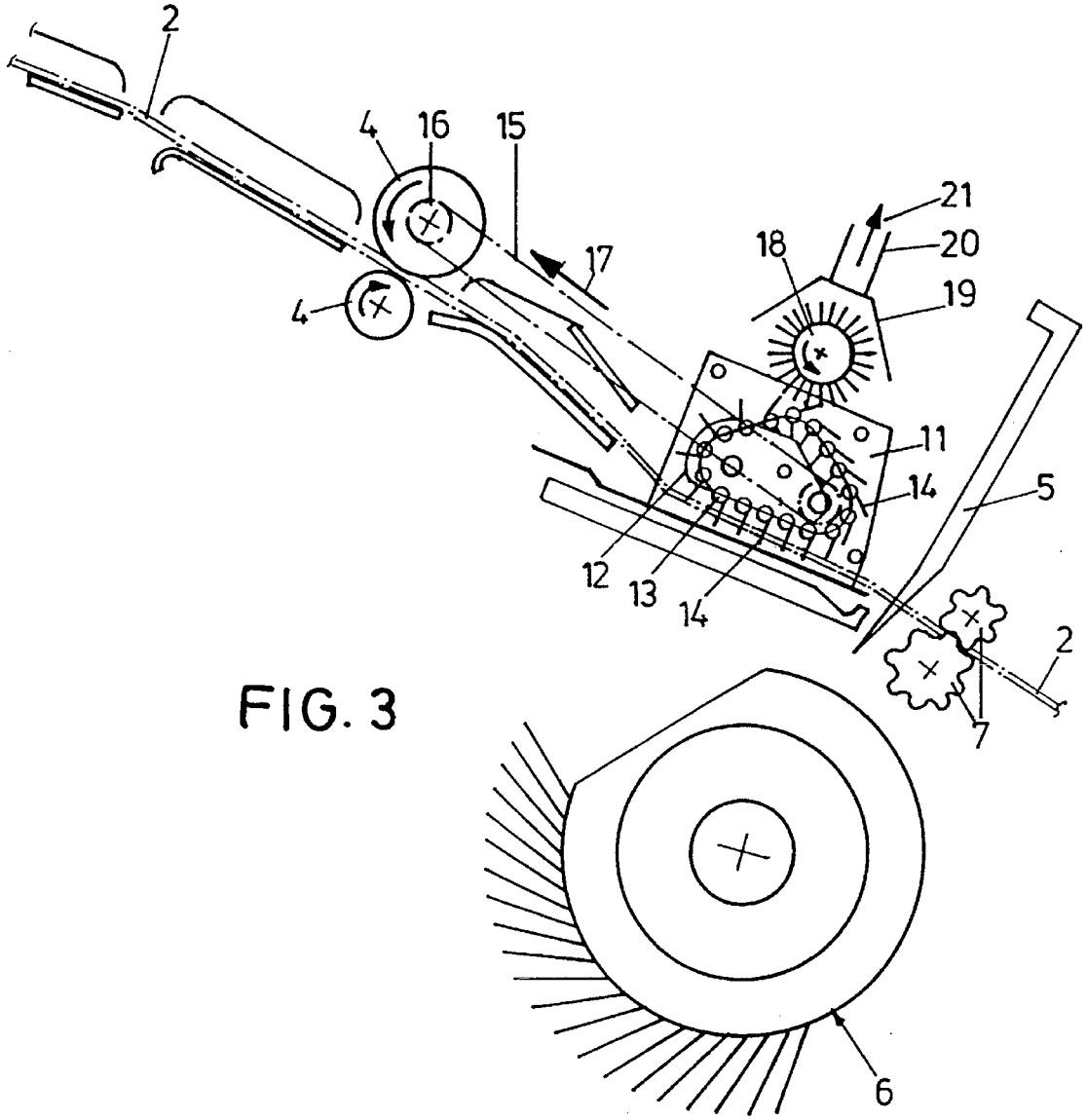

In contrast to that a feed comb arrangement according to the invention is illustrated in FIGS. 3 and 4. As shown in FIG. 4, this feed comb arrangement comprises two cheeks 11, on the inner side of which guideways 12 are provided for the motion of rotation of fallers 13 laterally supported in the guideways 12, which fallers 13 are provided with a plurality of needles or saw-toothed stamped elements 14, only some of them being outlined. There are crank projections, not shown in the drawing, of the fallers 13, which extend longitudinally to a separate guideway and which provide that the needles or points, respectively, of the saw-toothed stamped elements 14 related to the central longitudinal axis of each faller 13 are oriented as desired in each motion phase. The according embodiment is not further described here, as it is known per se from drawing equipment. The same applies for the drive of the fallers 13 on their motion of rotation, which may be performed e.g. with a linear drive, as it is described in European Patent 0 184 671, or with a chain wheel known per se, as it is described in German Published Application 25 48 315 or in U.S. Pat. No. 3,854, 169. In the shown example of embodiment the chain wheel is driven via a belt 15 and an external wheel 16 in the direction of the arrow 17, the belt 15 being driven via a feed roller (not shown in FIG. 4).

The guideways 12 in the cheeks 11 are formed such that alongside of a lower portion the needles or saw-toothed points 14, respectively, engage with the fiber web 2 and correspondingly can transport the fiber web 2 in a motion phase and retain it in a subsequent retaining phase, wherein they subsequently leave the fiber web and are lifted upwards. In an upper portion of the path of rotation a rotating cleaning brush 18 is arranged, which combs out impurities of the passing needles or saw-toothed points 14, a fume hood 19 connected with a suction port 20 providing that the combed out impurities are sucked off in the direction of the arrow 21.

What is claimed is:

1. A feed comb arrangement for a combing machine comprising an intermittently driven pair of feed rollers preceding said feed comb arrangement in the transport direction of a fiber web to be combed and a take-down arrangement in the form of take-down rollers, following said feed comb arrangement, wherein said feed comb arrangement comprises a plurality of fallers (13), which are intermittently driven in synchronization with the combing operation and which are respectively provided with needles or saw-toothed stamped elements (14), each of said plurality of fallers (13) respectively extending on two outer ends into a pair of closed guideways (12) allowing during part of a route of rotation said needles or saw-toothed points (14) around said guideway to respectively engage said fiber web (2) and thereafter, respectively, upwardly leave said fiber web (2) after having incrementally transported said fiber web.

2. A feed comb arrangement according to claim 1, wherein said each of plurality of fallers (13) comprise crank projections guided in separate guideways.

3. A feed comb arrangement according to claim 1, wherein means (18) for cleaning debris from the fiber web are mounted in the upper region of said guideway (12) of said fallers (13).

4. A feed comb arrangement according to claim 3, wherein means (19) for sucking the debris are mounted above said means for cleaning (18).

5. A feed comb arrangement according to claim 1, wherein the drive of said fallers (13) is derived from the drive of said feed rollers (4).

6. A feed comb arrangement according to claim 1, wherein each of said closed guideways has a first part arranged along a feed direction of the fiber web so that tips of the needles can engage the fiber web, a second part directed up and away from the feed direction and the fiber web so that the tips of the needles are removed from the fiber web in an upward direction, and a third part directed from an uppermost point of movement down to the fiber web with a component opposite to the feed direction such that the tips of the needles engage with the fiber web at a point upstream relative to the feed direction which is remote from a point where the tip of the needles left the fiber web.

* * * * *